US008602237B2

(12) United States Patent
Wurster et al.

(10) Patent No.: US 8,602,237 B2
(45) Date of Patent: Dec. 10, 2013

(54) PASTEURIZABLE AND HOT-FILLABLE BLOW MOLDED PLASTIC CONTAINER

(75) Inventors: Michael P. Wurster, York, PA (US); Justin A. Howell, New Cumberland, PA (US); Michael T. Kelly, Manchester, PA (US); Robert Waltemyer, Felton, PA (US); Benton A. Lewis, Manchester, PA (US)

(73) Assignee: Graham Packaging Company, L.P., York, PA (US)

( * ) Notice: Subject to any disclaimer, the term of this patent is extended or adjusted under 35 U.S.C. 154(b) by 521 days.

(21) Appl. No.: 12/573,900

(22) Filed: Oct. 6, 2009

(65) Prior Publication Data

US 2011/0079574 A1 Apr. 7, 2011

(51) Int. Cl.
*B65D 1/42* (2006.01)

(52) U.S. Cl.
USPC ..... 215/373; 215/383; 220/608; 220/672; 220/675

(58) Field of Classification Search
USPC ..... 215/373, 379–383; 220/606, 608, 672, 220/675
See application file for complete search history.

(56) References Cited

U.S. PATENT DOCUMENTS

| | | | | |
|---|---|---|---|---|
| D240,968 | S | 8/1976 | Hurst | |
| 3,973,693 | A * | 8/1976 | Brocklehurst | 220/604 |
| 4,108,324 | A | 8/1978 | Krishnakumar et al. | |
| D267,076 | S | 11/1982 | Hurtig | |
| 4,620,639 | A * | 11/1986 | Yoshino | 215/373 |
| 5,005,716 | A | 4/1991 | Eberle | |
| D332,751 | S | 1/1993 | Pischulti et al. | |
| 5,199,588 | A * | 4/1993 | Hayashi | 215/381 |
| 5,269,437 | A * | 12/1993 | Gygax | 220/606 |
| 5,477,974 | A | 12/1995 | Reil et al. | |
| 5,499,730 | A * | 3/1996 | Harbour | 215/382 |
| 5,908,127 | A * | 6/1999 | Weick et al. | 215/373 |
| 5,908,128 | A | 6/1999 | Krishnakumar et al. | |
| 5,989,661 | A | 11/1999 | Krishnakumar et al. | |
| D423,366 | S | 4/2000 | Gans | |

(Continued)

FOREIGN PATENT DOCUMENTS

| | | | |
|---|---|---|---|
| JP | 2000190935 | A * | 7/2000 |
| JP | 2000229615 | | 8/2000 |
| WO | 2004008834 | | 1/2004 |

OTHER PUBLICATIONS

International Search Report dated Aug. 3, 2011 for corresponding PCT/US2010/051426 filed Oct. 5, 2010.

*Primary Examiner* — Sue A Weaver
(74) *Attorney, Agent, or Firm* — Baker Botts, LLP

(57) ABSTRACT

A blow molded plastic container for hot fill and pasteurization uses includes a main body portion that is shaped so as to be substantially rectangular in horizontal cross-section and a base portion. The base portion is shaped to define a generally rectangular standing ring and an elevated push-up portion that is positioned radially inward of the standing ring. The push-up portion includes a central region, an annular, substantially straight and substantially vertical rise portion that is positioned immediately radially inward of the standing ring and a plurality of radially oriented waves. Each of the waves extends radially outwardly from the central region to the vertical rise portion. The main body portion is shaped so as to have sidewall portions that are bounded by a plurality of vertically extending edge portions. In one embodiment, at least one of the vertically extending edge portions may have at least one inwardly extending gusset.

22 Claims, 7 Drawing Sheets

(56) References Cited

U.S. PATENT DOCUMENTS

| | | | | |
|---|---|---|---|---|
| D423,935 | S | 5/2000 | Frazer | |
| 6,065,624 | A * | 5/2000 | Steinke | 215/383 |
| D426,469 | S | 6/2000 | Mankowski et al. | |
| D435,455 | S | 12/2000 | Gans | |
| 6,161,713 | A * | 12/2000 | Krich | 215/384 |
| 6,216,942 | B1 * | 4/2001 | Kittscher | 229/4.5 |
| D443,521 | S | 6/2001 | Bansal et al. | |
| D444,391 | S | 7/2001 | Bansal et al. | |
| D445,339 | S | 7/2001 | Bazlur | |
| D448,675 | S | 10/2001 | Thierjung | |
| D455,656 | S | 4/2002 | Gans et al. | |
| 6,413,466 | B1 | 7/2002 | Boyd et al. | |
| 6,439,413 | B1 | 8/2002 | Prevot et al. | |
| 6,460,714 | B1 | 10/2002 | Silvers et al. | |
| D465,418 | S | 11/2002 | Thierjung | |
| D482,625 | S | 11/2003 | Crawford et al. | |
| 6,763,968 | B1 | 7/2004 | Boyd et al. | |
| D496,855 | S | 10/2004 | Trude | |
| 6,920,992 | B2 | 7/2005 | Lane et al. | |
| 7,044,325 | B2 * | 5/2006 | Przytulla et al. | 220/672 |
| 7,073,675 | B2 | 7/2006 | Trude | |
| 7,080,747 | B2 | 7/2006 | Lane et al. | |
| D529,389 | S | 10/2006 | Trude | |
| D531,909 | S | 11/2006 | Keller et al. | |
| 7,165,693 | B2 * | 1/2007 | Oguchi et al. | 215/381 |
| 7,185,525 | B2 * | 3/2007 | Werth et al. | 72/379.4 |
| 8,096,434 | B2 | 1/2012 | Bunel et al. | |
| 8,276,775 | B2 * | 10/2012 | Boukobza | 215/381 |
| 2003/0052076 | A1 | 3/2003 | Cheng et al. | |
| 2003/0136754 | A1 | 7/2003 | Bourque et al. | |
| 2003/0196926 | A1 | 10/2003 | Tobias et al. | |
| 2004/0211746 | A1 | 10/2004 | Trude | |
| 2005/0196569 | A1 * | 9/2005 | Lisch et al. | 428/35.7 |
| 2006/0006133 | A1 * | 1/2006 | Lisch et al. | 215/374 |
| 2006/0131257 | A1 | 6/2006 | Gatewood et al. | |
| 2007/0000858 | A1 * | 1/2007 | Boukobza | 215/373 |
| 2007/0199918 | A1 * | 8/2007 | Sabold | 215/383 |
| 2008/0000867 | A1 | 1/2008 | Lane et al. | |
| 2008/0041812 | A1 | 2/2008 | Stowitts | |
| 2010/0012618 | A1 * | 1/2010 | Boukobza | 215/383 |

* cited by examiner

PASTEURIZABLE AND HOT-FILLABLE BLOW MOLDED PLASTIC CONTAINER

BACKGROUND OF THE INVENTION

1. Field of the Invention

This invention relates to blow molded plastic containers, and particularly blow molded plastic containers that are designed to accommodate the pressurization and vacuum forces that are inherent in the pasteurization and/or hot fill processes.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

The use of blow molded plastic containers for the purpose of packaging liquids that are processed by hot filling and/or pasteurization processes has been known for some time. The hot fill process involves filling the containers while the liquid product is at an elevated temperature, typically 68° C. to 96° C. (155° F.-205° F.) and usually about 85° C. (185° F.) in order to sterilize the container at the time of filling. Containers that are designed to withstand the hot fill process are known as "hot fill" or "heat set" containers. Such containers are typically designed with sidewalls that include one or more vacuum panels that are designed to flex due to the temperature changes and consequent volumetric expansion and contraction that takes place during processing.

Pasteurization subjects a container to greater internal pressures and volumetric changes than occurs with hot-fill processing. This is due to the higher processing temperatures, and, therefore, the greater volumetric expansion and contraction of the contained products and associated vapor.

Hot fill and pasteurizable containers must be designed to be strong enough in the areas outside of the vacuum panel regions so that the deformation that occurs as a result of the volumetric shrinkage of a product within the container is substantially limited to the portions of the container that are designed specifically to accommodate such shrinkage. Ideally, this is done while keeping the container as lightweight as possible, because PET resin is relatively expensive.

The sidewall portions of hot fill and pasteurizable containers must be designed to prevent excessive deformation, particularly in containers that are not designed to be substantially circular or round as viewed in horizontal cross-section. In addition, the base of such containers must be designed to be stable and to prevent excessive deformation. PET hot fill and pasteurizable containers typically have a modified champagne style base that defines an outer standing ring on which the container is designed to be supported when placed on a flat horizontal surface, and a central, elevated push-up region. The push-up region of such containers has a tendency to deform when the container is under pressure, which can cause the material near the standing ring to roll or deflect outwardly, thus compromising the stability of the base.

A need exists for an improved blow molded plastic container for use in hot fill and pasteurizable applications that has a sidewall and base portion that both remain relatively stable under various conditions of pressurization and temperature that occur during such processes.

SUMMARY OF THE INVENTION

Accordingly, it is an object of the invention to provide an improved blow molded plastic container for use in hot fill and pasteurizable applications that has a sidewall and base portion that both remain relatively stable under various conditions of pressurization and temperature that occur during such processes.

In order to achieve the above and other objects of the invention, a blow molded plastic container according to a first aspect of the invention includes a main body portion that is shaped so as to be substantially rectangular in horizontal cross-section and a base portion. The base portion is shaped to define a generally rectangular standing ring and an elevated push-up portion that is positioned radially inward of the standing ring. The push-up portion includes a central region, an annular, substantially straight and substantially vertical rise portion that is positioned immediately radially inward of the standing ring and a plurality of radially oriented waves. Each of the waves extends radially outwardly from the central region to the vertical rise portion.

According to a second aspect of the invention, a blow molded plastic container includes a base portion; and a main body portion. The main body portion is shaped so as to have a plurality of sidewall portions that are bounded by a plurality of vertically extending edge portions. At least one of the vertically extending edge portions has at least one inwardly extending gusset defined therein.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
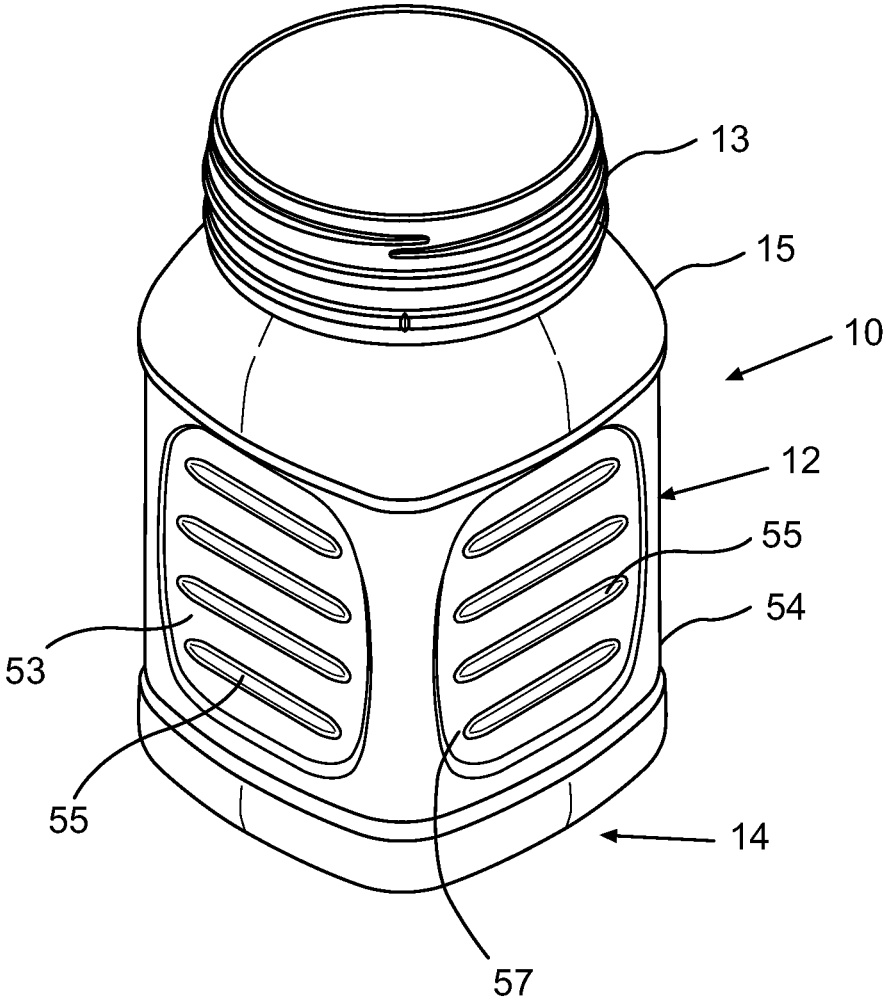
FIG. 1 is a perspective view depicting a blow molded plastic container according to a preferred embodiment of the invention.
Figure 2:
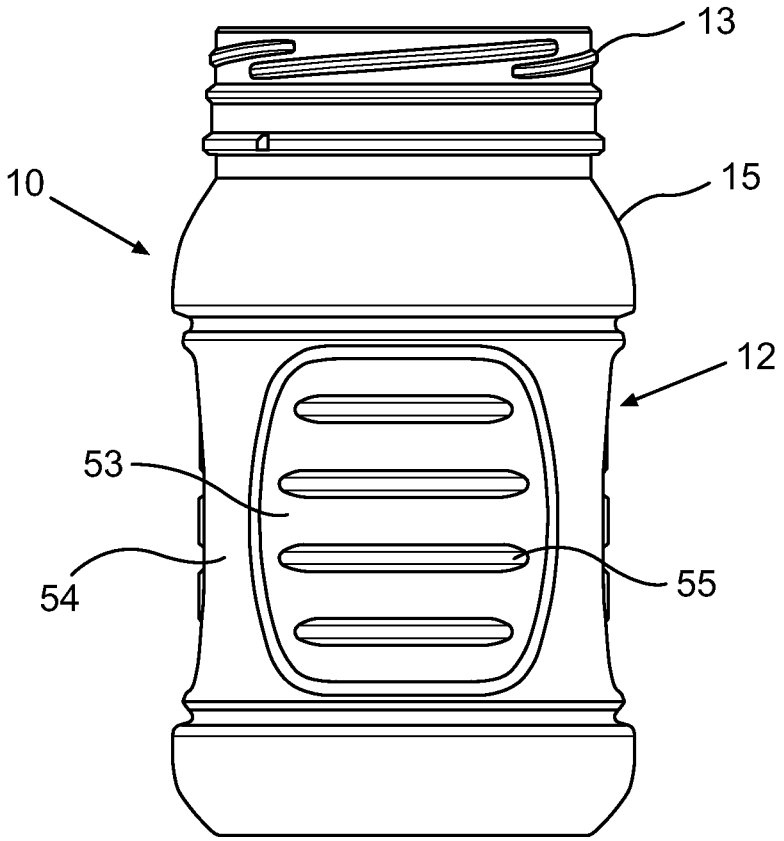
FIG. 2 is a side elevational view of the container that is depicted in FIG. 1.

Referring now to the drawings, wherein like reference numerals designate corresponding structure throughout the views, and referring in particular to FIG. 1, a blow molded plastic container 10 is constructed and arranged to be pasteurizable and/or adapted to be used for packaging liquid products at elevated temperatures according to the well-known hot-fill process.

Blow molded plastic container 10 is preferably fabricated from polyethylene terephthalate, commonly known by the acronym PET, using a conventional blowmolding process. It preferably includes a main body portion 12, a threaded nipple portion 13 that is provided with one or more helical threads for receiving a threaded lid, a base portion 14 and a shoulder portion 15 that is unitary with the threaded nipple portion 13 and the main body portion 12.

The main body portion 12 is preferably shaped so as to be substantially rectangular in horizontal cross-section, and more preferably so as to be substantially square in horizontal cross-section.

Main body portion 12 includes four sidewall panels 53 and four vertically extending edge portions 54. Each of the sidewall panels 53 preferably has a plurality of inwardly extending support ribs or grooves 55 defined therein for strengthening the sidewall panels 53 against inward and outward deflection that might otherwise occur as a result of temperature-induced pressure changes within the container 10 during the hot fill or pasteurization process. The inwardly extending support ribs or grooves 55 are in the preferred embodiment provided within a generally oval region 57 that is defined in the sidewall 53. Preferably, each of the support ribs 55 is oriented so as to be substantially horizontal.

Figure 3:
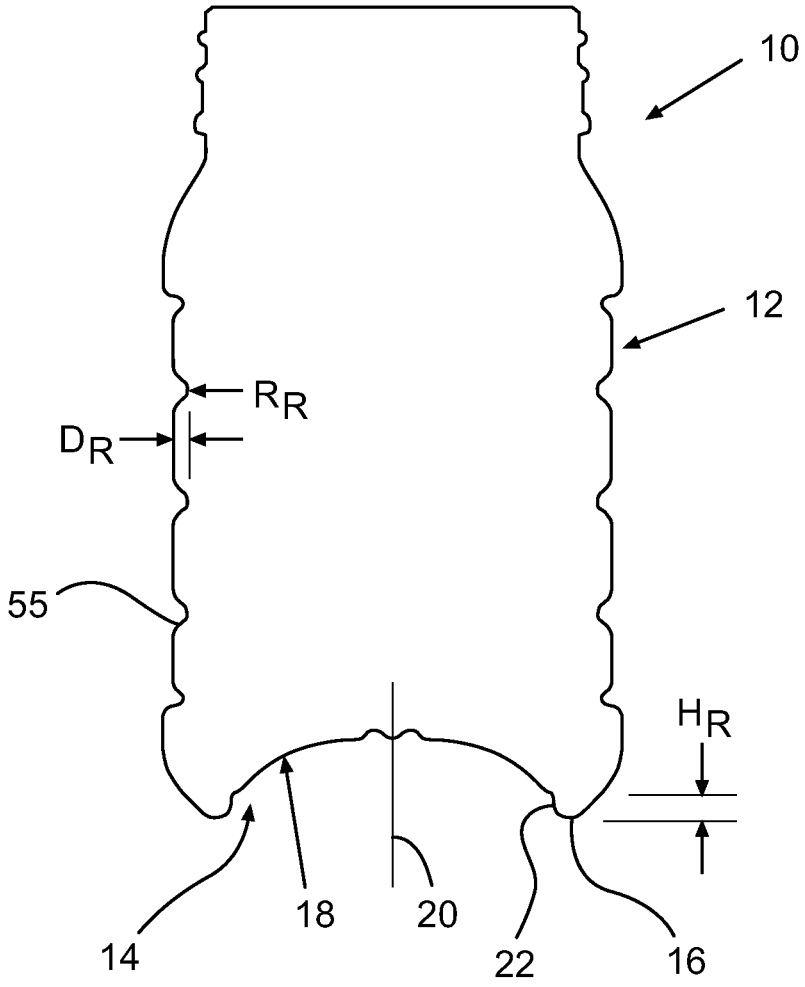
FIG. 3 is a longitudinal cross-sectional view of the container that is depicted in FIG. 1.

As is best shown in FIG. 3, each of the inwardly extending support ribs or grooves 55 further preferably has a depth $D_R$ that is within a range of 0.050 inch to about 0.2 inch.

Figure 4:
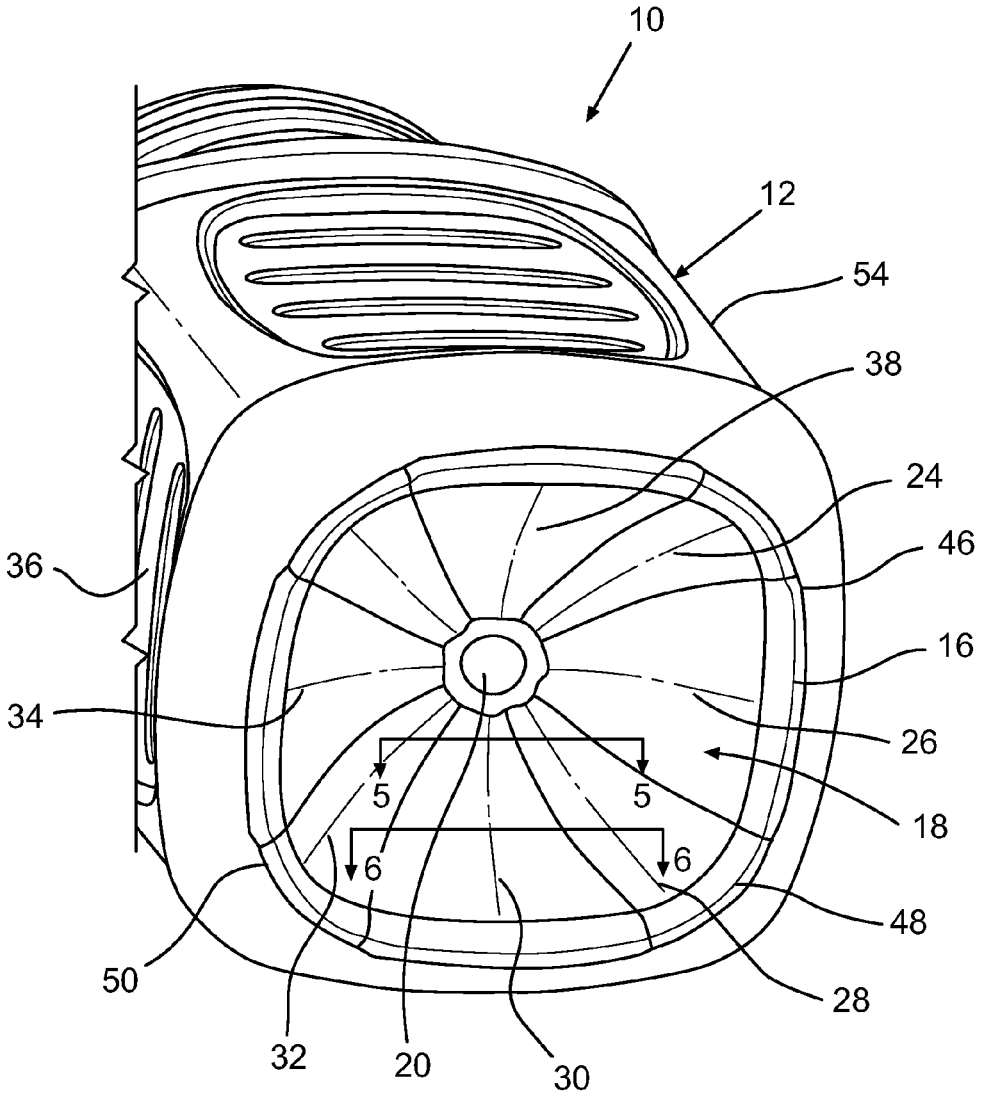
FIG. 4 is a fragmentary perspective view of a bottom portion of the container that is depicted in FIG. 1.

Referring briefly to FIG. 4, base portion 14 is shaped so as to define a generally rectangular and, more preferably, a generally square rectangular standing ring 16 having rounded corners on which the container 10 is adapted to be supported on an underlying flat horizontal surface such as a table or refrigerator shelf. Base portion 14 further includes an elevated push-up portion 18 that is positioned radially inward of the standing ring 16. The elevated push-up portion 18 has a bottom wall portion that is shaped to define a central region 20 that includes a gate structure and that is substantially centered with respect to the elevated push-up portion 18 and the generally rectangular standing ring 16.

The base portion 14 also preferably includes an annular, substantially straight vertical rise portion 22, best shown in FIG. 3, that is positioned immediately radially inward of the standing ring 16. The vertical rise portion 22 preferably extends for a vertical height $H_R$ from the bottom of the standing ring 16 that is preferably within a range of about 0.036 inch to about 0.2 inch.

According to one particularly advantageous feature of the invention, base portion 14 also includes a plurality of radially oriented waves 24, 26, 28, 30, 32, 34, 36, best shown in FIG. 4, that extend radially outwardly from the central region 20 to the vertical rise portion 22. Each of the radially oriented waves 24, 26, 28, 30, 32, 34, 36 includes a peak portion 42 that is preferably convexly radiused to extend downwardly and a trough portion 44 that is preferably concavely radiused so as to extend upwardly. A first cross-sectional view showing a plurality of the radially oriented waves and their respective peak and trough portions 42, 44 at a location that is adjacent to the central region 20 is provided in FIG. 5. A second cross sectional view showing a plurality of the radially oriented waves in the respective peak and trough portions 42, 44 at a location that is adjacent to the vertical rise portion 22 is shown in FIG. 6.

The generally rectangular standing ring 16 has four corner portions 46, 48, 50, 52 that are preferably constructed so as to be slightly rounded. Each of the corner portions 46, 48, 50, 52 is in the preferred embodiment radially aligned with a peak portion 42 of a corresponding wave. This facilitates efficient material distribution into the areas closest to the corner portions 46, 48, 50, 52 as well as optimizing the structural reinforcement of the base portion 14.

The peak portion 42 of each respective radially oriented wave 24, 26, 28, 30, 32, 34, 36 defines a radially oriented axis. Each of the waves 24, 26, 28, 30, 32, 34 also defines a first transverse mean radius of curvature $R_1$, shown in FIG. 5, at a first location that is shown in FIG. 4. Each of the waves further defines a second transverse mean radius of curvature $R_2$, shown in FIG. 6, at a second location that is shown in FIG. 4. The second location is positioned so as to be radially outward from the first location. The second transverse mean radius of curvature $R_2$ is preferably greater than the first transverse mean radius of curvature $R_1$, meaning that the peak portions of the waves tend to increase in both amplitude and width in proportion to the distance from the central region 20 of the bottom portion 16.

Figure 5:
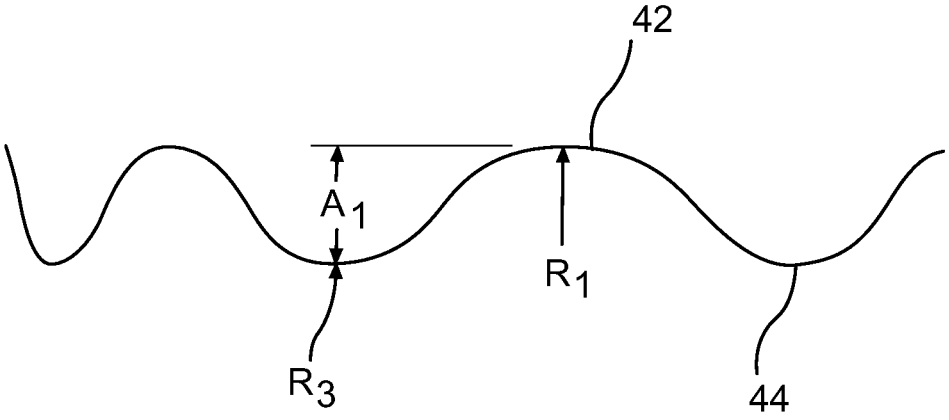
FIG. 5 is a cross-sectional view taken along lines 5-5 in FIG. 4.
Figure 6:
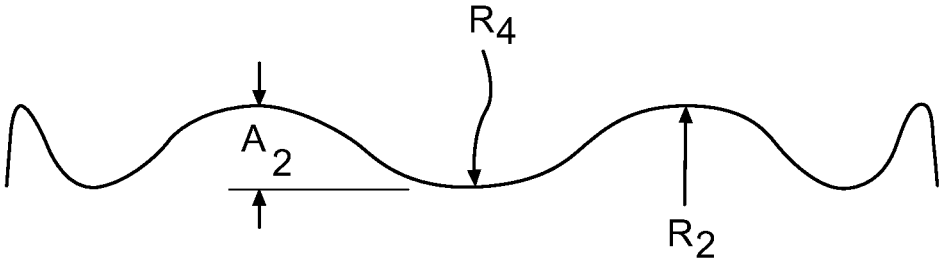
FIG. 6 is a cross-sectional view taken along lines 6-6 in FIG. 4.

Likewise, the trough portion 44 of each of the waves also defines a radially oriented axis, and each of the waves defines a first trough transverse mean radius of curvature $R_3$, shown in FIG. 5, at the first location that is shown in FIG. 4. Each of the waves further defines a second trough transverse mean radius of curvature $R_4$, shown in FIG. 6, at the second location that is shown in FIG. 4. The second location is positioned so as to be radially outward from the first location. The second transverse mean radius of curvature $R_4$ is preferably greater than the first transverse mean radius of curvature $R_3$, meaning that the trough portions of the waves also tend to increase in amplitude and width in proportion to the distance from the central region 20 of the bottom portion 16.

Preferably, both the trough portions 44 and the peak portions 42 are shaped so as to subtend a substantially constant angle along their respective lengths from the central region 20 to the vertical rise portion 22.

The waves 24, 26, 28, 30, 32, 34 are preferably symmetrically arranged about the central region 20, meaning that each of the waves has a diametrically opposed counterpart wave positioned immediately and symmetrically opposite the central region 20.

Preferably, at least four waves are provided. More preferably, at least six waves are provided. In the preferred embodiment, eight waves are provided. More than eight waves could also be provided within the scope of the invention.

Figure 7:
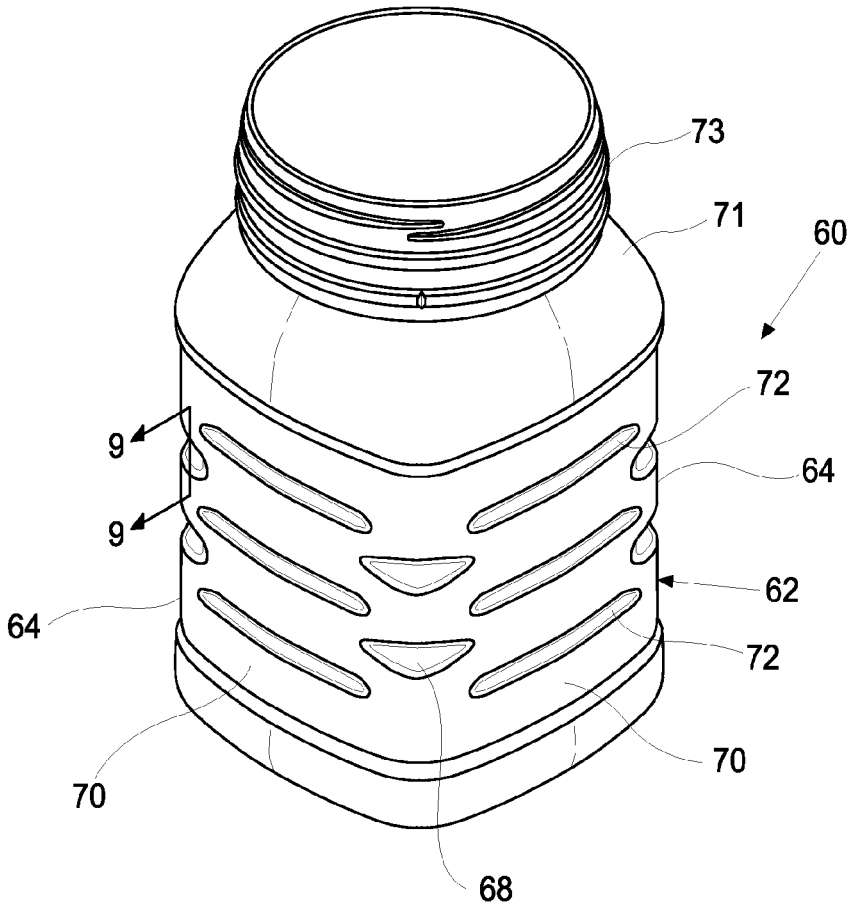
FIG. 7 is a perspective view depicting a blow molded plastic container according to an alternative embodiment of the invention.
Figure 8:
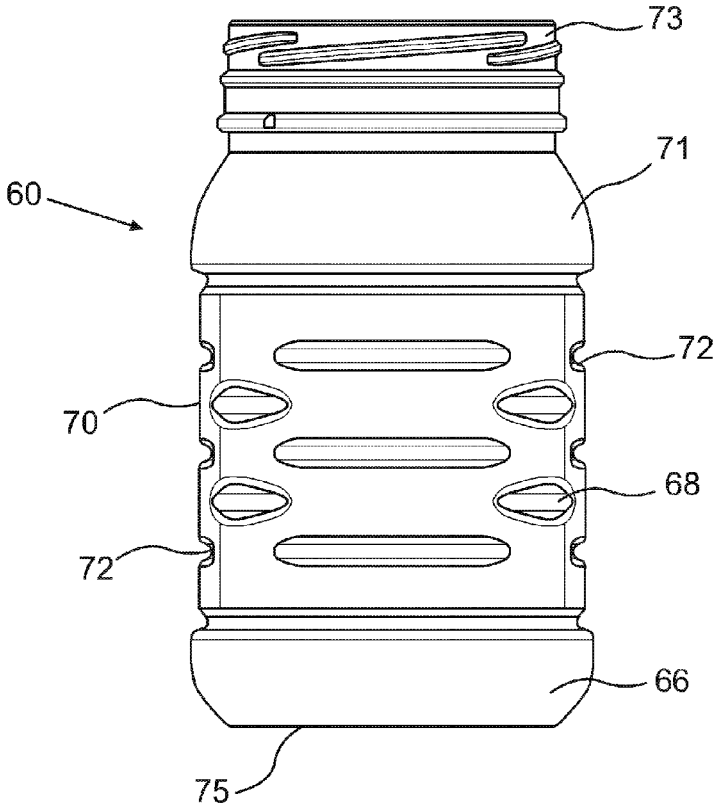
FIG. 8 is a side elevational view of the container that is shown in FIG. 7.
Figure 9:
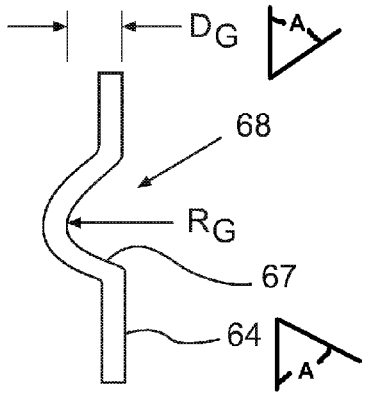
FIG. 9 is a cross-sectional view taken along lines 9-9 in FIG. 7.

A blow molded plastic container 60 that is constructed according to a second embodiment of the invention is shown in FIGS. 7-9. Container 60 is substantially identical to the container 10 described above, except that it is also provided with additional sidewall reinforcement in the vertically extending corners or posts, as will be described in greater detail below. It is also constructed and arranged to be used in high temperature and pressure applications such as pasteurization and hot-fill processing. It includes a main body portion 62 that is preferably rectangular and more preferably substantially square as viewed in horizontal cross-section.

The main body portion 62 is shaped so as to have a plurality of the sidewall portions 70 that are bounded by a corresponding plurality of vertically extending edge portions 64 that are slightly rounded and that provide rigidity to the main body portion 62.

Container 60 further includes a base portion 66 that is constructed identically to the base portion 14 in the above described embodiment, a neck portion 71 and a threaded nipple portion 73 that is provided with external threading so as to receive a threaded lid. Container 60 further has a base portion 75 that is constructed identically to the base portion of the previously described embodiment.

Each of the sidewall portions 70 preferably has at least one inwardly extending support rib 72 defined therein that are constructed identically to the inwardly extending support ribs 55 described above with reference to the first embodiment. Preferably, a plurality of support ribs 72 are defined in each of the sidewall portions 70, and each of the support ribs 72 are oriented so as to be substantially horizontal.

According to one advantageous feature of this aspect of the invention, at least one of the vertically extending edge portions 64 has at least one inwardly extending gusset 68 defined therein. Preferably, a plurality of and more preferably each of the vertically extending edge portions 64 includes at least one gusset 68. Preferably, each of the vertically extending edge portions 64 has more than one gusset 68 defined therein. The gussets 68 provide enhanced structural support to the container 60 that permits relative lightweighting of the container while maintaining the strength of the container.

As is shown in the cross-sectional depiction that is provided in FIG. 9, each of the gussets 68 is in the preferred embodiment characterizsed by a concave groove 67 that is defined in the sidewall of the main body portion 62. Specifically, the groove 67 is defined in the vertically extending edge portion 64 and preferably extends along an axis that forms substantially equal angles A with respective planes in which the adjacent sidewall portions 70 reside.

The groove 67 has a depth $D_G$, which is preferably within a range of about 0.125 inch to about 0.500 inch. Groove 67 further is concavely radiused at a mean radius of curvature RG that is preferably within a range of about 0.0625 inch to about 0.250 inch.

The inwardly extending gussets 68 are in the preferred embodiment not disposed in the same horizontal plane as any of the support ribs 72.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A blow molded plastic container, comprising:

a main body portion, said main body portion being shaped so as to be substantially rectangular in horizontal cross-section; and a base portion, said base portion defining a generally rectangular standing ring and an elevated push-up portion that is positioned radially inward of said standing ring, and wherein said push-up portion has a bottom wall portion that is shaped to define:

a central region;

an annular, substantially straight and substantially vertical generally rectangular rise portion that is positioned immediately radially inward of said standing ring; and a plurality of radially oriented waves, each of said waves extending radially outwardly from said central region continuously to said generally rectangular vertical rise portion.

2. A blow molded plastic container according to claim 1, wherein each of said waves includes a peak portion that is convexly radiused to extend downwardly and a trough portion that is concavely radiused to extend upwardly.

3. A blow molded plastic container according to claim 2, wherein said generally rectangular standing ring has four corner portions, and wherein each of said corner portions is radially aligned with a peak portion of a corresponding wave.

4. A blow molded plastic container according to claim 2, wherein said peak portion has a radially oriented axis, a first transverse mean radius of curvature at a first location, and a second transverse mean radius of curvature at a second location that is radially outward from said first location, and wherein said second transverse mean radius of curvature is greater than said first transverse mean radius of curvature.

5. A blow molded plastic container according to claim 2, wherein said trough portion has a radially oriented axis, a first transverse mean radius of curvature at a first location, and a second transverse mean radius of curvature at a second location that is radially outward from said first location, and wherein said second transverse mean radius of curvature is greater than said first transverse mean radius of curvature.

6. A blow molded plastic container according to claim 1, wherein said vertical rise portion extends for a vertical height from said standing ring that is within a range of about 0.036 inch to about 0.2 inch.

7. A blow molded plastic container according to claim 1, wherein each of said waves is shaped so as to subtend a substantially constant angle along its length.

8. A blow molded plastic container according to claim 1, wherein said waves are symmetrically arranged about said central region.

9. A blow molded plastic container according to claim 1, wherein at least four of said waves are provided.

10. A blow molded plastic container according to claim 1, wherein at least six of said waves are provided.

11. A blow molded plastic container according to claim 1, wherein said substantially rectangular main body portion has a plurality of vertically extending edge portions, and wherein at least one of said edges has at least one inwardly extending gusset defined therein.

12. A blow molded plastic container according to claim 1, wherein said container is fabricated from polyethylene terephthalate (PET).

13. A heat sterilizable blow molded plastic container, comprising:

a base portion; and a main body portion, said main body portion being substantially rectangular in transverse cross-section and shaped so as to have a plurality of sidewall portions that are bounded by a plurality of vertically extending edge portions; and wherein at least one of said vertically extending edge portions has at least one inwardly extending gusset defined therein, the gusset having a concave inner surface.

14. A blow molded plastic container according to claim 13, wherein at least one of said sidewall portions has at least one support rib defined therein.

15. A blow molded plastic container according to claim 14, wherein said support rib is oriented so as to be substantially horizontal.

16. A blow molded plastic container according to claim 15, wherein said inwardly extending gusset is not disposed in the same horizontal plane as said support rib.

17. A blow molded plastic container according to claim 13, wherein said at least one of said vertically extending edge portions has a plurality of said inwardly extending gussets defined therein.

18. A blow molded plastic container according to claim 13, wherein a plurality of said vertically extending edge portions have at least one inwardly extending gusset defined therein.

19. A blow molded plastic container according to claim 18, wherein each of said vertically extending edge portions has a plurality of said inwardly extending gussets defined therein.

20. A blow molded plastic container according to claim 13, wherein said container is fabricated from polyethylene terephthalate (PET).

21. A blow molded plastic container according to claim 13, wherein the gusset is defined by a groove that extends along an axis that forms substantially equal angles with respective planes in which the adjacent sidewall portions reside.

22. A blow molded plastic container according to claim 13, wherein each of the sidewall portions includes a plurality of substantially horizontally oriented structural reinforcement features, and wherein the gusset is not disposed in a common horizontal plane with any of the horizontally oriented structural reinforcement features.

* * * * *